United States Patent [19]

Casale

[11] Patent Number: 4,984,310

[45] Date of Patent: Jan. 15, 1991

[54] LAVATORY PAN SEAT

[76] Inventor: Enzo Casale, Lodge Farm House, Elmers Lane, Saxlingham Thorpe, Norwich, Norfolk, England

[21] Appl. No.: 381,099

[22] Filed: Jul. 17, 1989

[51] Int. Cl.[5] ..... E03D 9/052

[52] U.S. Cl. ..... 4/347; 4/213; 4/217

[58] Field of Search ..... 4/217, 237, 347, 348, 4/352, 472, 475, 477, 482, 447, 448, 213

[56] References Cited

U.S. PATENT DOCUMENTS

| | | | |
|---|---|---|---|
| 2,389,165 | 11/1945 | Riedele | 4/217 |
| 3,533,112 | 10/1970 | Poister | 4/217 |
| 3,740,772 | 6/1973 | Paley | 4/217 |
| 4,117,559 | 10/1978 | Boyle | 4/348 X |
| 4,251,888 | 2/1981 | Turner | 4/217 X |
| 4,301,555 | 11/1981 | Poister | 4/217 |
| 4,317,242 | 3/1982 | Stamper | 4/217 X |
| 4,402,091 | 9/1983 | Ellis et al. | 4/217 |
| 4,617,687 | 10/1986 | Wadsworth | 4/217 X |
| 4,748,698 | 6/1988 | Kao | 4/217 |
| 4,853,981 | 8/1989 | Hunnicutt, Jr. | 4/217 X |

FOREIGN PATENT DOCUMENTS

| | | | |
|---|---|---|---|
| 445105 | 2/1949 | Italy | 4/217 |
| 610613 | 4/1979 | Switzerland | 4/217 |

*Primary Examiner*—Henry J. Recla
*Assistant Examiner*—Robert M. Fetsuga
*Attorney, Agent, or Firm*—Edwin D. Schindler

[57] ABSTRACT

A lavatory pan seat formed in fitted together upper and lower parts defining between them an air flow channel with which communicate air inlet apertures having entrances at the inner periphery of the seat and an air extraction aperture having an exit at the outer periphery of the seat.

5 Claims, 7 Drawing Sheets

LAVATORY PAN SEAT

FIELD OF THE INVENTION

This invention relates to a lavatory pan seat.

BACKGROUND TO THE DISCLOSURE

The rooms in which lavatories are housed can be rendered unpleasantly odorous after use of the lavatory, and partly for this reason these rooms are sometimes equipped with extraction fans to communicate the room atmosphere with the atmosphere outside the building. It is an object of this invention to provide an alternative solution to this problem.

BRIEF SUMMARY OF THE INVENTION

According to the invention, there is provided a lavatory pan seat having a shape generally conforming to the shape of the rim of a conventional lavatory pan and adapted to be hinged to said pan at the back of the rim, wherein the seat has at least one air inlet aperture in its wall adjacent its inside periphery, communicating with an opening for air extraction in its wall adjacent its outside periphery.

In practice, the seat, when fitted to the pan, communicates via its air extraction opening with a hose through which air is drawn by a fan and passed to a stench pipe or the atmosphere outside the building, whereby odours are withdrawn directly from the space within the pan and substantially prevented from entering the room in which the lavatory is located. Preferably, therefore, the seat is equipped with a microswitch connected to cause operation of the fan when the lavatory is used, as by sitting on the seat.

A preferred seat has a plurality of air inlet apertures in its wall adjacent its inside periphery, and an air flow channel within the interior of said seat extending around at least part of its curved length, the air inlet apertures and the air extraction opening communicating with said channel. Conveniently, therefore, the seat is preferably formed in generally similarly shaped upper and lower parts which define the air flow channel between them.

BRIEF DESCRIPTION OF DRAWINGS

A practical embodiment of pan seat in accordance with this invention is exemplified in the following description, making reference to the accompanying drawings, in which.

DESCRIPTION OF EMBODIMENT

Figure 1B:
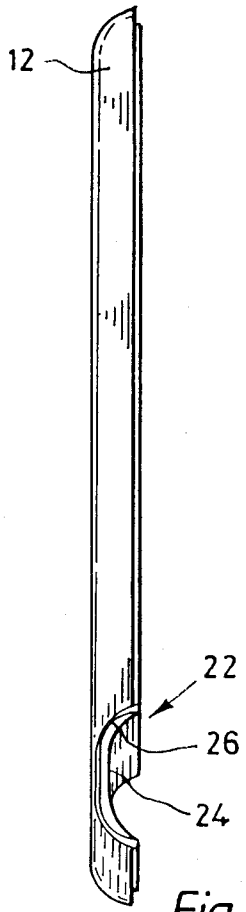
FIGS. 1A, 1B and 1C are respectively views of the upperside, edge and underside of the lower part of the pan seat.
Figure 1A:
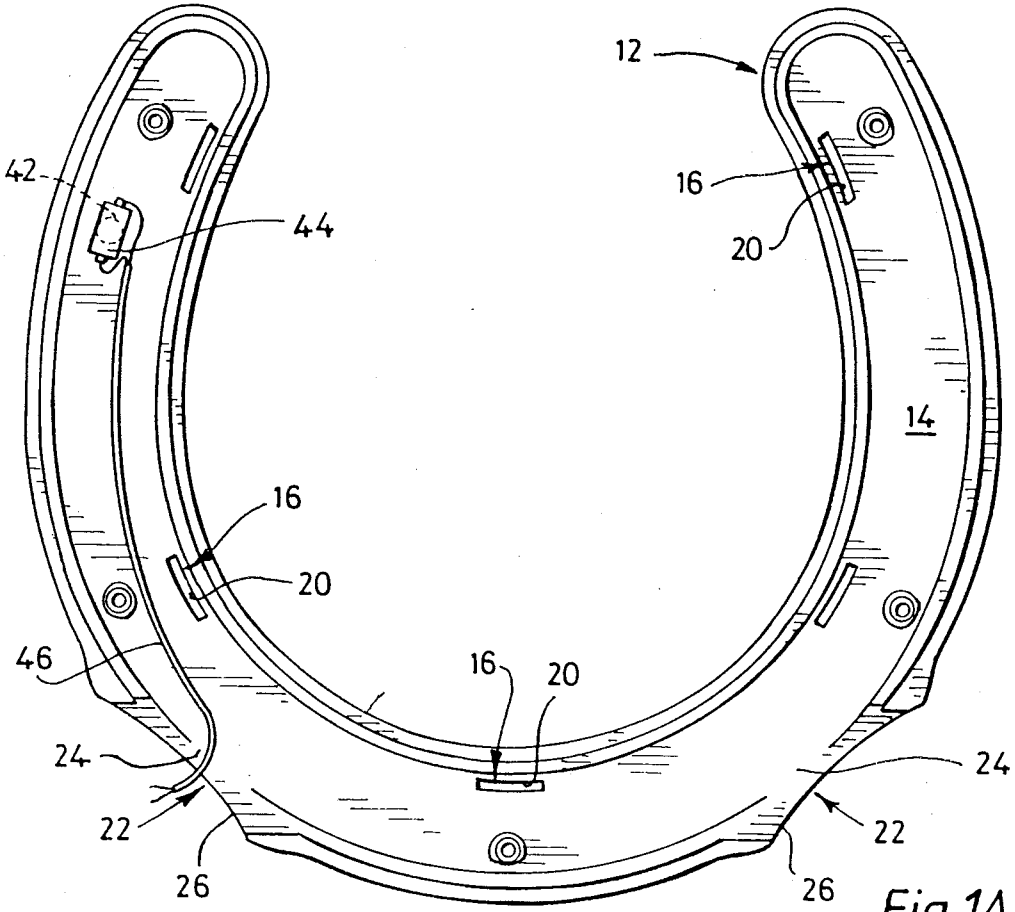
Figure 1C:
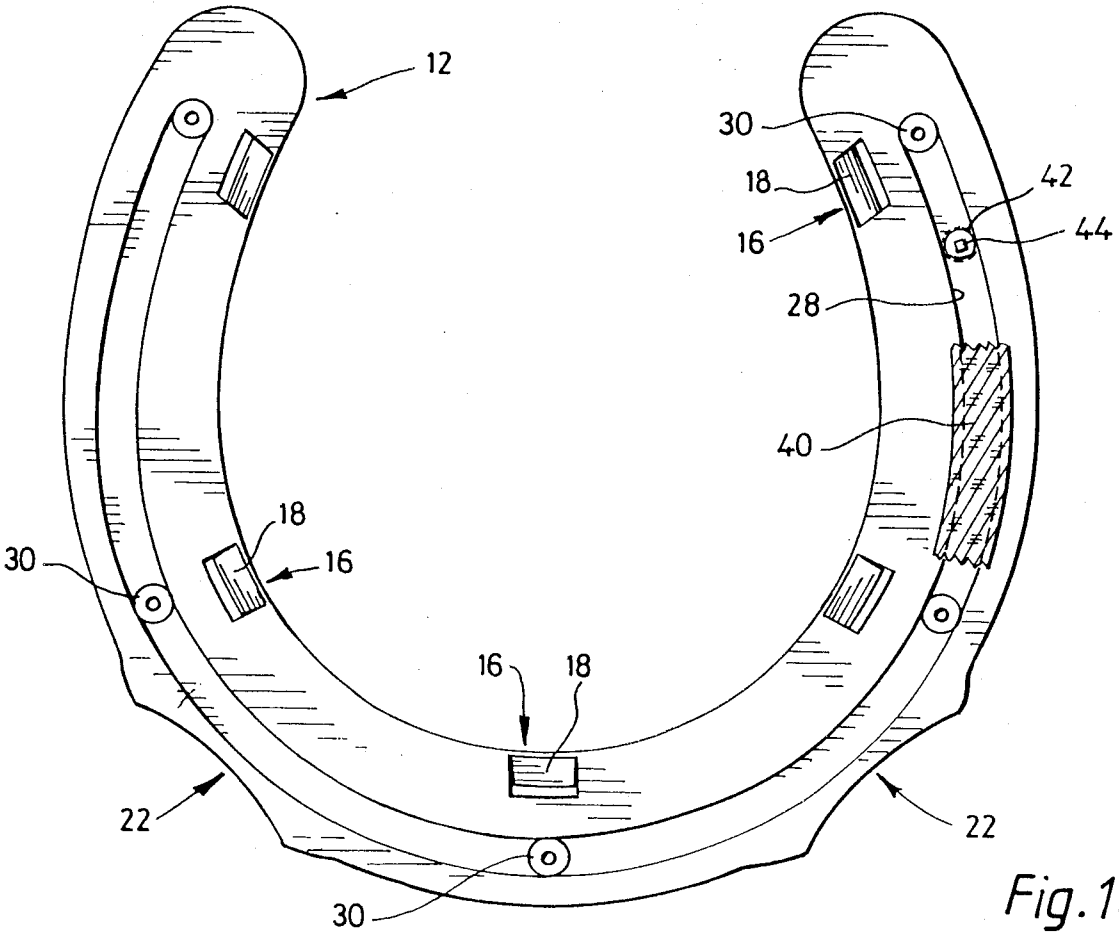

The pan seat comprises an upper part 10 which can be assembled with a lower part 12. Both parts have a shape generally conforming to the shape of the rim of a conventional lavatory pan, but the lower part (FIG. 1) has a perimeter incomplete at the front, and thus assumes a shape similar to that of a horseshoe.

The lower part 12 is formed on its upperside with a side air flow groove 14 extending around the length of the part, the groove terminating just before the two ends of the part. Formed through the wall of the part 12, at the inside periphery thereof are air inlet apertures 16, the entrances 18 to which face both generally downwardly and generally towards the geometric centre of the lower part. The exits 20 of the apertures 16 open into the groove 14. The illustrated embodiment has five angularly spaced apertures 16, one at the back centre and two on each side thereof. Adjacent the back of the part 12, on each side of the back centre, the part is formed through its wall with an air extraction aperture 22, the entrance 24 to which communicates with the groove 14. The exit 26 of the air extraction aperture faces outwardly.

The lower part 12 is provided on its underside with a sealing strip groove 28 extending around the length of the part, closer to its outside edge than its inner edge. A sealing strip (shown in part at 40 in FIG. 1C) fitted to the groove will cover the heads of screws extending through screw holes 30 provided to enable the lower and upper parts of the seat to be fixed together.

A hole 42 is also provided at the underside of the part 12, right through to the groove 14, for accommodating a microswitch 44. The microswitch is in use operated by pressure on and compression of the sealing strip 40 at the point where the microswitch is located. A connecting lead 46 (FIG. 1A) to the microswitch 44 extends around the groove 14 to emerge through the air extraction aperture 22.

Figure 2A:
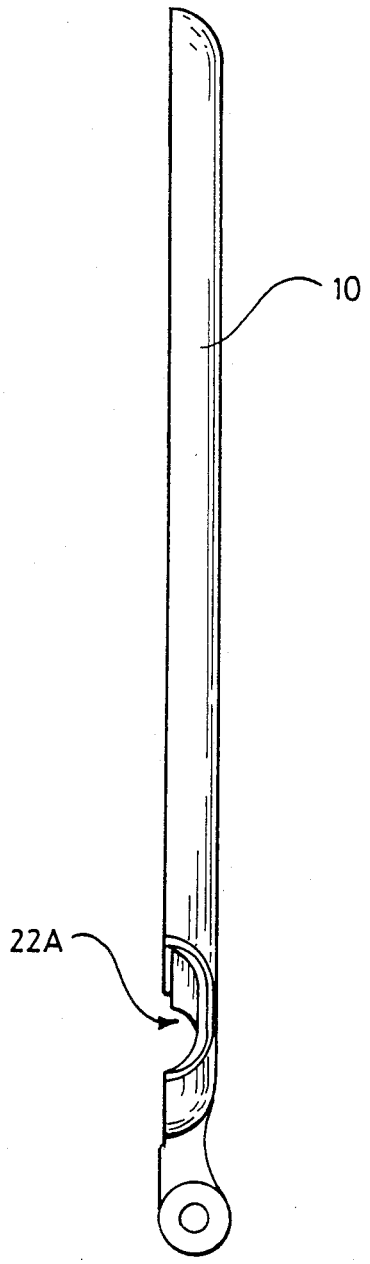
FIGS. 2A and 2B are respectively views of the edge and underside of the upper part of the pan seat.
Figure 2B:
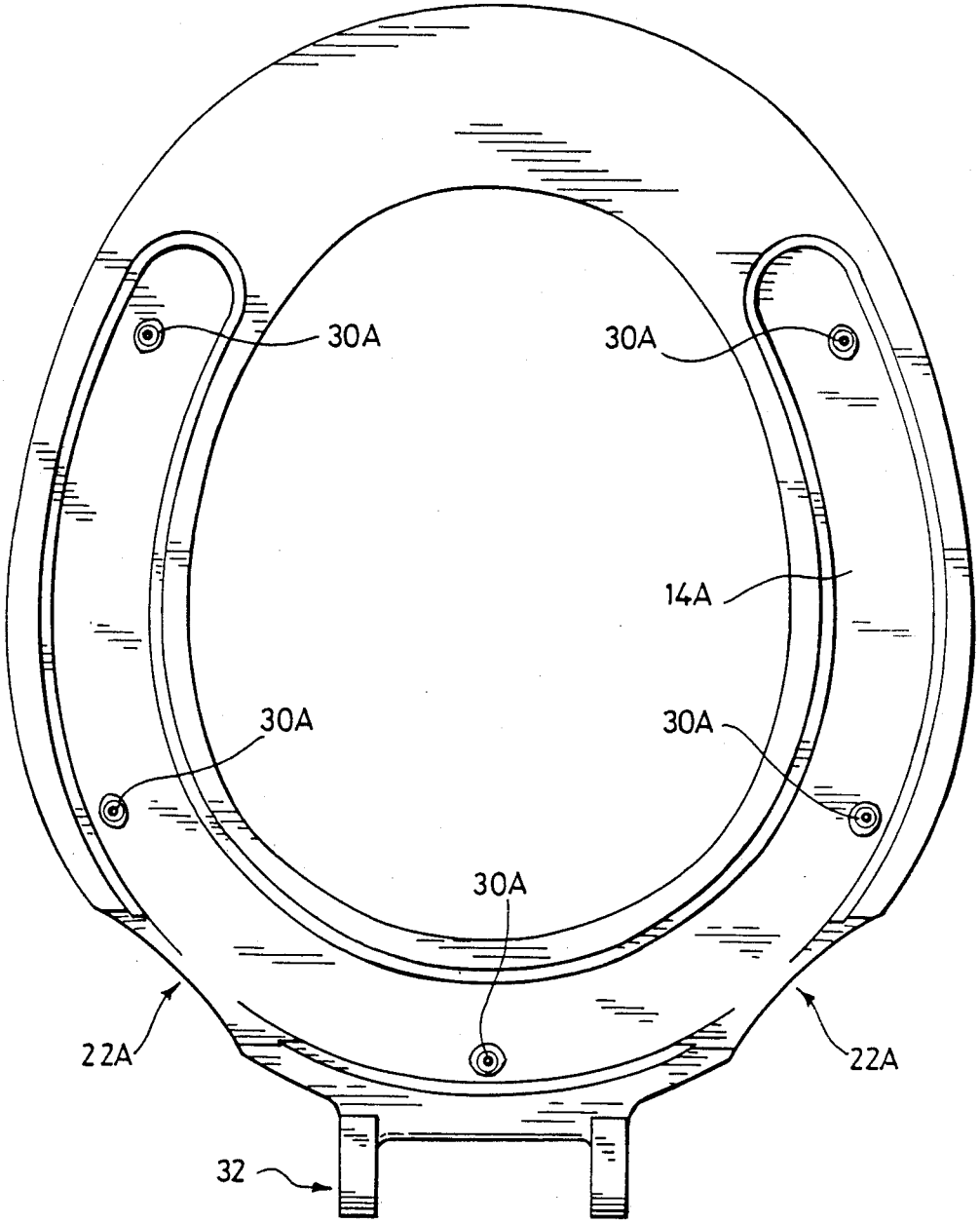

The upper part 10 of the seat, as shown in FIG. 2, has a complete perimeter, and is formed around the major part of its length, on its underside, with a groove 14A matching the groove 14 in the lower part 12. A portion 22A of the air extraction aperture is also formed in this upperpart, as well as the inner closed ends 30A of the screw holes.

In FIG. 2, reference 32 indicates a provision for hinging the seat to the back of a lavatory pan, in the conventional manner.

The parts 10 and 12 may conveniently be moulded of plastics material.

Figure 3A:
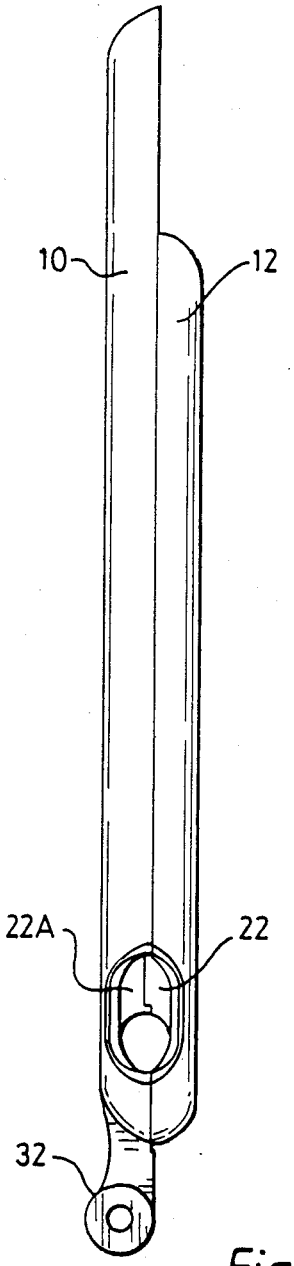
FIGS. 3A, 3B and 3C are respectively views of the edge, upperside and median cross-section of the pan seat assembled from the lower and upper parts.
Figure 3C:
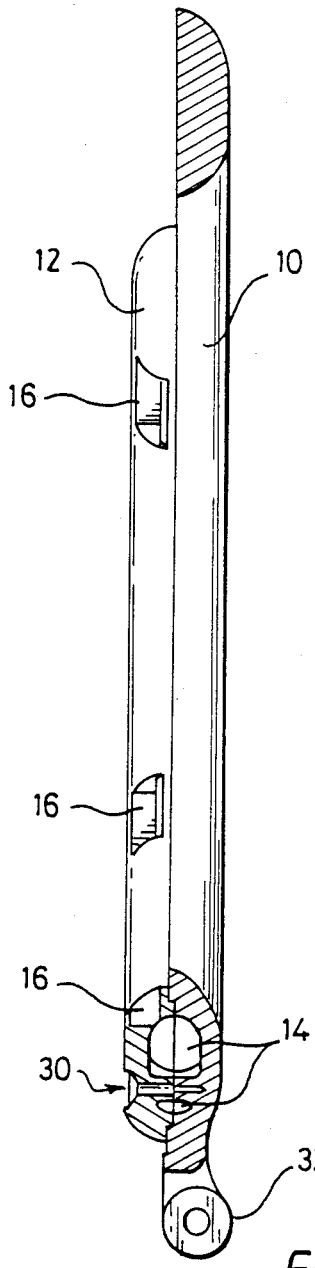
Figure 3B:
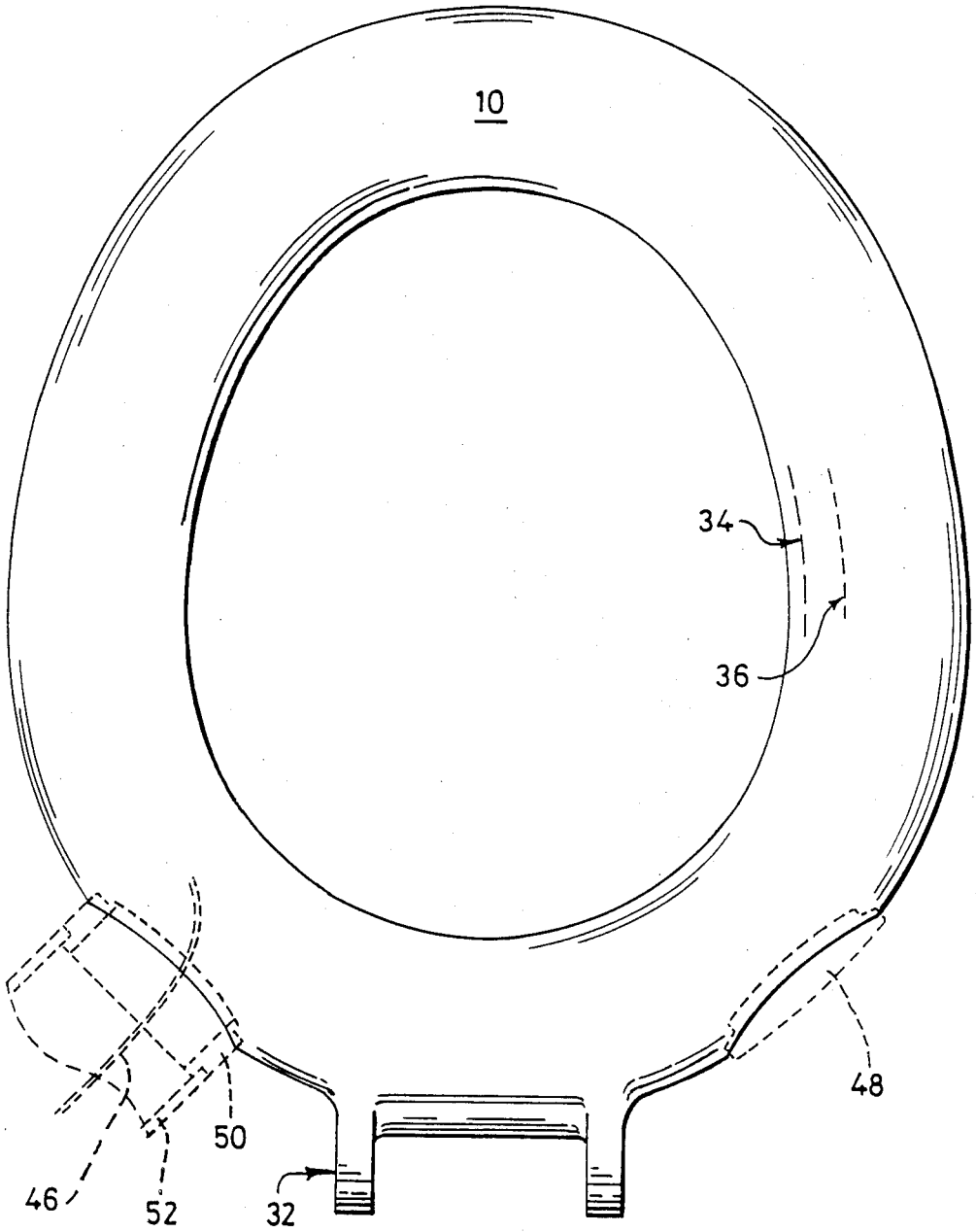

FIG. 3 shows the upper and lower parts 10, 12 in assembled condition. The upperside of the upper part is smooth and unbroken, and is contoured in a conventional manner. References used in FIG. 3 correspond to those employed in FIGS. 1 and 2. It will be seen that the upper part 10 is wider than the lower part 12 and, for completeness, reference 34 is used in FIG. 3B to indicate the approximate position of the inner periphery of the lower part 12 relative to the inner periphery of the upper part whilst reference 36 indicates the approximate position of the inner periphery of the pan rim, when the seat is fitted in position. The sealing strip will thus be positioned approximately around the centre line of the pan rim. When the upper and lower parts 10, 12 are fitted together, along with the microswitch 44 and its connecting lead 46, a blanking plate or plug 48 will be simultaneously secured in one air extraction aperture 22, depending on the requirement for air extraction on the right or the left. A tube connecting socket 50, for example analogous to a vacuum cleaner pipe fitting, will be simultaneously secured in the other air extraction opening.

Figure 4:
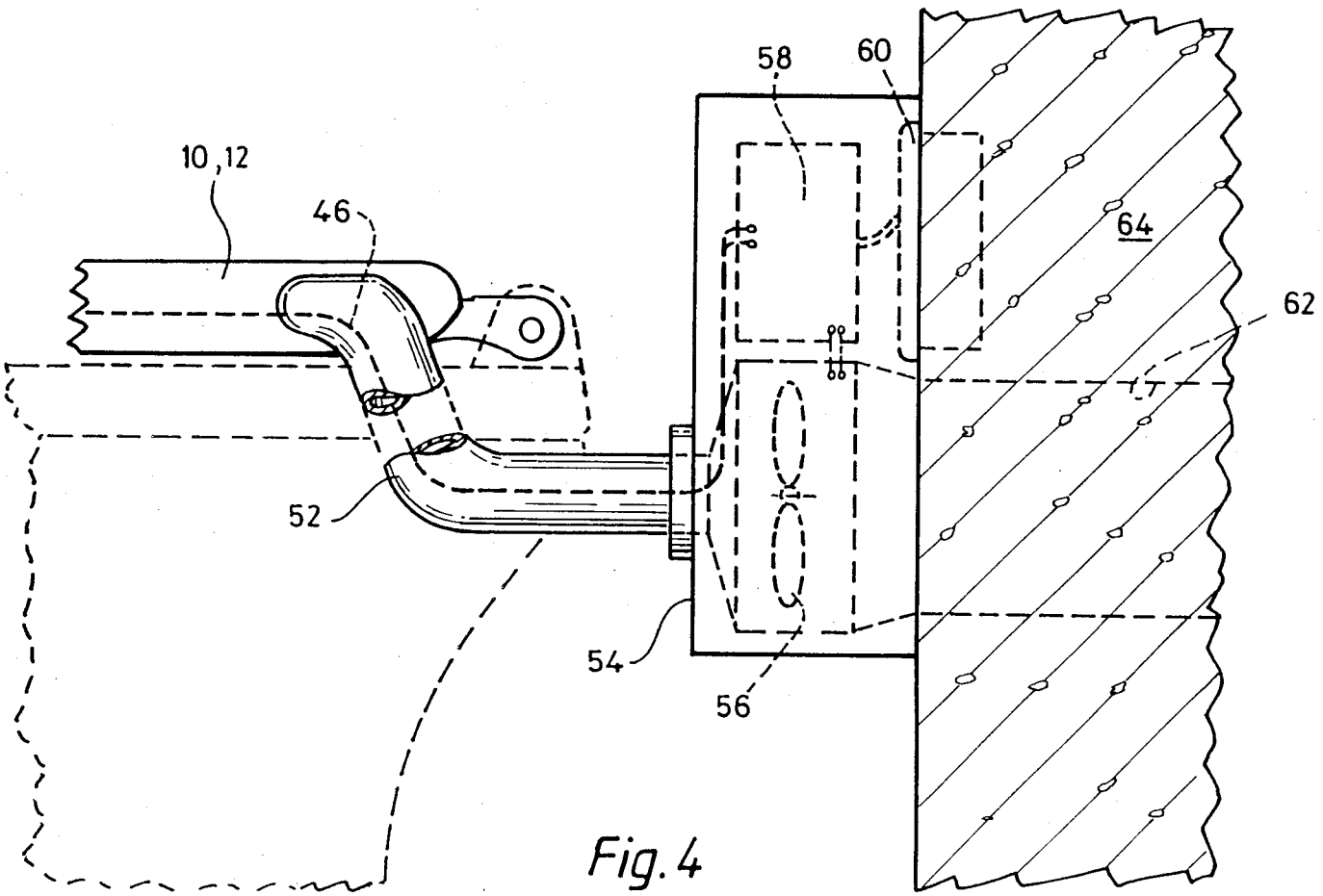
FIG. 4 is a side elevational view of a lavatory pan assembly incorporating the pan seat.

As shown in FIG. 4, the seat will be used in combination with a small housing 54 accommodating a "silent" fan 56 and a relay-timer 58, the housing fitting directly over an electric power supply inlet 60 on the wall 64 adjacent the back of the lavatory pan. A length of hose 52, flexible enough to accommodate the hinging movement of the seat 10, 12 will connect the air extraction aperture with the interior of the housing, which will otherwise be sealed except for an outlet opening leading via a short pipe 62 to a stench pipe or to the atmosphere outside the building. Operation of the relay-timer 58, which in turn controls the operation of the fan 56, will be determined by the microswitch, the connecting lead 46 from which will extend into the interior of the housing through the flexible air extraction hose 52.

Thus, in use, when the lavatory is used by a person sitting on the seat, the microswitch will trigger the relay timer, which will set the fan in operation for the duration of closure of the microswitch and for a preselected period thereafter.

As the space within the pan is substantially closed (although at least able to draw in fresh air via the gap created by the incomplete front of the lower part of the seat), any odours produced within the space will be directly extracted, and escape into the room where the lavatory is located will be substantially prevented.

Various modifications of the afore-described and illustrated embodiment are possible within the scope of the invention as defined by the appended claims.

I claim:

1. A lavatory pan seat having a shape substantially conforming to the shape of a rim of a conventional lavatory pan and having hinge mounting means whereby said pan seat is hingeable to said pan at a back of the rim, wherein the improved lavatory pan seat, comprises:

a plurality of air inlet apertures in a wall of said pan seat adjacent the inside periphery of said pan seat, and an opening for air extraction in said pan seat wall adjacent the outside periphery of said pan seat;

passage means communicating with said inlet openings and said air extraction opening, said passage means comprising an air flow channel within the interior of said pan seat extending around at least part of a curved length of said pan seat;

substantially similarly curved upper and lower parts which define said air flow channel between them, the lower part having a substantially horseshoe shape, with an incomplete perimeter at the front; and, means fixing said upper and said lower parts together, wherein said lower part of said pan seat includes:

a resilient strip around at least a major part of its curved length and for sealing against the pan rim; and, a microswitch and an opening to a hole with said microswitch being accommodated in the hole and being arranged for operation by compression of said resilient strip, which covers both the opening to the microswitch hole and said fixing means securing said upper and lower parts together, said microswitch being provided to control the operation of power means for extracting air through the air extraction opening.

2. A pan seat according to claim 1 wherein the pan seat has a plurality of air inlet angularly spaced around its curved length symmetrically on both sides of the hinge mounting means, and has two air extraction openings adjacent its hinge mounting means, one on each side thereof, one for blanking off in use.

3. A pan seat according to claim 2, having a blanking plate covering one air extraction opening and a connection socket for a flexible air extraction hose at the other air extraction opening, the blanking plate and connection socket being secured in position by the fixed together upper and lower parts of the seat.

4. A pan seat according to claim 1, wherein the at least one air inlet aperture has an entrance which faces both generally downwardly and generally towards the geometric centre of the seat.

5. A pan seat according to claim 1, in combination with a sealed housing adapted for wall mounting at an electric power supply, the housing containing a relay and a fan controlled by the relay, the interior of the housing communicating both with the air extraction opening of the pan seat via a flexible hose and with the external atmosphere via a vent pipe, and wherein the relay is a relay timer triggered by the microswitch to switch on the fan for the duration of closure of the microswitch and a predetermined period following opening of the microswitch.

* * * * *